US006119558A

United States Patent [19]

Foley, Jr.

[11] Patent Number: 6,119,558

[45] Date of Patent: Sep. 19, 2000

[54] MANUAL PIPE TONG HAVING SECONDARY SAFETY LATCH

[76] Inventor: Lawrence E. Foley, Jr., 203 Beau Pre Rd., Lafayette, La. 70508

[21] Appl. No.: 09/296,095

[22] Filed: Apr. 21, 1999

[51] Int. Cl.[7] ..... B25B 13/00

[52] U.S. Cl. ..... 81/90.5; 81/90.7

[58] Field of Search ..... 81/90.3–90.9

[56] References Cited

U.S. PATENT DOCUMENTS

| | | | |
|---|---|---|---|
| 1,334,250 | 3/1920 | Langford | 81/90.7 |
| 2,093,788 | 9/1937 | Vaughn | 81/90.8 |

*Primary Examiner*—James G. Smith
*Assistant Examiner*—David B. Thomas
*Attorney, Agent, or Firm*—Jesse D. Lambert

[57] ABSTRACT

Manual pipe tong comprising secondary latch. The pipe tong comprises a handle and a plurality of linked jaw segments pivotally attached to the handle. Two of the segments are first and second latch segments, and are releasably engageable to form a primary latch. The primary latch may be released and the jaw segments opened to encircle a tubular for makeup of a threaded connection. The first latch segment comprises substantially parallel upper and lower surfaces, and projections on each of those surfaces. A hooking member on the second latch segment comprises a pair of spaced-apart hooks joined by a handle, and is rotably disposed on the second latch segment so that the hooks sandwich the second latch segment. The hooking member is rotatable between first and second positions, and in the second position the hooks engage the projections on the first latch segment so as to form a secondary safety latch. In the event of a tong jaw segment failure, the secondary safety latch keeps the jaw segment fragments linked to the unbroken jaw segments, preventing projectiles from being formed by the fragments. The secondary safety latch also prevents unintentional unlatching of the primary latch.

6 Claims, 5 Drawing Sheets

MANUAL PIPE TONG HAVING SECONDARY SAFETY LATCH

BACKGROUND

1. Field of the Invention

This invention relates to an improved apparatus for making up threaded tubular connections. More specifically, the present invention relates to a manual pipe tong having a handle and jaws connected thereto, and comprising a secondary safety latch which, in the event of a tong failure due to fracturing of the tong jaw segments, keeps the fractured pieces of the tong jaw segments connected together, thereby preventing the pieces from flying outward and potentially injuring workers. The improved tong of the present invention also prevents unintentional opening of the tong jaws, which may occur due to a failure of the tong line.

2. Related Art

Threaded connections are used to join lengths of tubulars in many different applications. Although the ensuing description addresses primarily the use of such tubulars (commonly known as "drill pipe") in the drilling of earth boreholes, such as for oil and gas wells, it is understood that the scope of the present invention encompasses manual tongs used to make up threaded connections on tubulars in any application.

Each section or "joint" of drill pipe typically has an upset at each end, one end comprising a pin connection and the other a box connection. This upset section, commonly referred to as a "tool joint", provides a larger diameter surface which may be readily engaged by pipe tongs, as will be described below.

Manual pipe tongs typically comprise several linked-together and articulated jaw segments (sometimes collectively referred to as "jaws"), the jaw segments pivotally connected to an extended handle, which, as the ensuing description will show, creates a lever for the application of torque to the threaded connection. At least some of the jaw segments contain dies, which are hardened teeth to grip the surface of the tubular to be tightened, such as the tool joints of the drill pipe. The jaws include at least two segments, comprising first and second latch segments, which form a primary latch which permits the jaws to be opened, encircled about a tubular, then latched closed by engaging the first latch segment with a mating part of the second latch segment. Once the jaws are closed about the tool joint, the drill pipe connection is then "made up" by pulling on the handle (which provides greatly increased leverage, as the pull point is displaced several feet from the axis of rotation), usually by a cable or chain connected to a cat head on the rig drawworks, which can provide tremendous pulling force. This operation is reversed to unscrew or "breakout" the threaded connection. The torque required to make up and breakout drill pipe connections is quite high, and consequently the pulling force on the tongs is high, with resulting great stress on the various components of the tong, and in particular the jaw segments.

A large percentage of the major accidents which occur on a drilling rig floor involve failure of the drill pipe tongs, when such tongs are subjected to great stress. A typical occurrence is a catastrophic failure by fracture of a jaw segment, with the result that the tong jaws fly open, come unlatched, and the unlatched and thereby free-flying fragment or fragments thus created (which may weigh, for example, 40 to 160 pounds) flies outward with tremendous force. Any rig worker in the path of such projectile would certainly be injured, and perhaps killed. Catastrophic failures of this nature are minimized by careful design and testing of the pipe tong components before use. In addition to testing, it is further desirable to link together any fragments of the jaw segments created by a failure of one or more jaw segments, so that such fragments remain connected to the pipe tong and cannot fly any great distance away, thereby greatly reducing or eliminating injury and death due to such projectiles.

Some additional number of accidents occur when pipe tong jaws come unlatched when under stress, the pipe tongs then suddenly swinging around under influence of the pulling force and striking a worker. Such unlatching may be caused by a failure of the line pulling the tong. It is therefore further desirable to provide a means to prevent unintentional and undesired unlatching of the pipe tongs.

SUMMARY OF THE PREFERRED EMBODIMENT OF THE PRESENT INVENTION

The present invention comprises an improved manual pipe tong, comprising a secondary safety latch which links together the tong jaw segments so that even in the event of a jaw segment failure, the jaw segment fragments remain connected to the pipe tong. The secondary safety latch also prevents unintentional opening of the jaw latch.

The improved manual pipe tong of the present invention comprises a handle with jaws connected thereto, the jaws comprising a plurality of linked-together segments which are pivotally connected to the handle. Two of the jaw segments are not pinned to one another, but comprise first and second latch segments having mating shapes which together form a primary latch which may be opened to permit the jaws to be placed about a tubular.

The present invention further comprises a secondary latch, wherein the first latch segment comprises upper and lower surfaces and an outwardly-extending projection on each of the upper and lower surfaces. The second latch segment comprises a hooking member pivotally attached thereto, which includes a pair of opposed, spaced-apart hooks joined by a handle. The hooks are disposed adjacent the upper and lower surfaces of the second latch segment, thereby sandwiching the second latch segment therebetween. When the primary latch is engaged by engagement of the first and second latch segments, the secondary safety latch may be engaged by pivoting the hooking member on the second latch segment, so as to engage the hooks about the projections of the first latch segment. With the secondary safety latch thus engaged, any fragments resulting from failure of jaw segments remain linked to other jaw segments and ultimately to the tong handle, and are thus prevented from flying outward. Further, the secondary latch keeps the primary latch from unintentional opening.

DETAILED DESCRIPTION OF THE PRESENTLY PREFERRED EMBODIMENT

The presently preferred embodiment of the present invention comprises an improved manual pipe tong comprising a primary latch and a secondary safety latch. Although the ensuing description contains certain specificities related to presently preferred embodiments of the invention, it is understood that the scope of the invention is not limited thereby, but encompasses all manual pipe tongs having both primary and secondary latches, wherein the secondary latch serves to maintain any fragments of the tong jaws in linked-together relation with the tong handle in the event of a tong jaw failure and prevents unintentional opening of the tong jaws. The scope of the appended claims likewise covers all embodiments of such manual pipe tongs.

Figure 1:
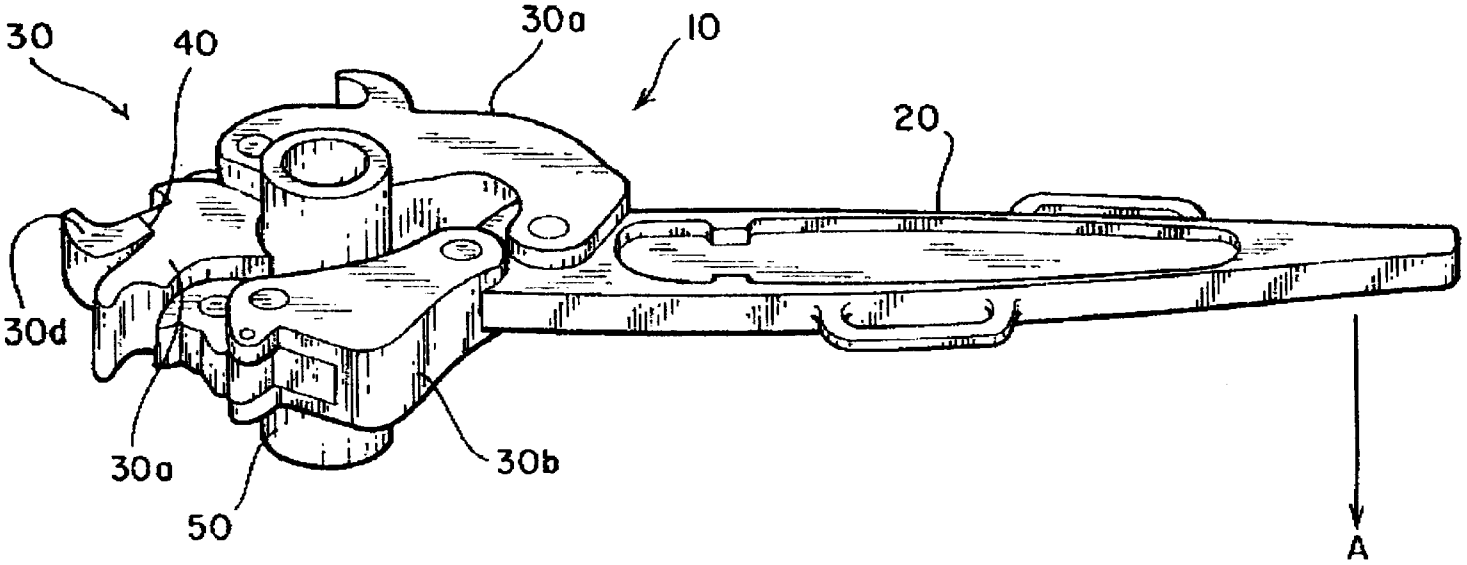
FIG. 1 (PRIOR ART)
FIG. 1 is a perspective view of a prior art manual pipe tong engaged about a tubular.

FIG. 1 shows a prior art manual pipe tong. The pipe tong 10 comprises a handle 20 and jaws 30, the jaws 30 comprising several linked together segments, enumerated jaw segments 30*a*, 30*b*, and first and second latch segments 30*c* and 30*d*, respectively. It is to be noted that although a total of four jaw segments are illustrated herein, the particular number of jaw segments is not critical, but rather illustrative only. Jaws 30 are pivotally connected to handle 20. First latch segment 30*d* engages second latch segment 30*c*, forming a primary latch 40. Second latch segment 30*d* may be rotated out of engagement with first latch segment 30*c*, permitting jaws 30 to be opened up, a tubular 50 to be engaged within jaws 30, and first and second latch segments 30*c* and 30*d* thereafter engaged to close and encircle the jaws around the tubular. By pulling on handle 20 (denoted by the arrow A), usually by means of a cable or chain connected to a drilling or workover rig drawworks or the like, jaws 30 tighten about tubular 50 and torque may be applied to the connection through the lever aspect of handle 20.

Figure 2:
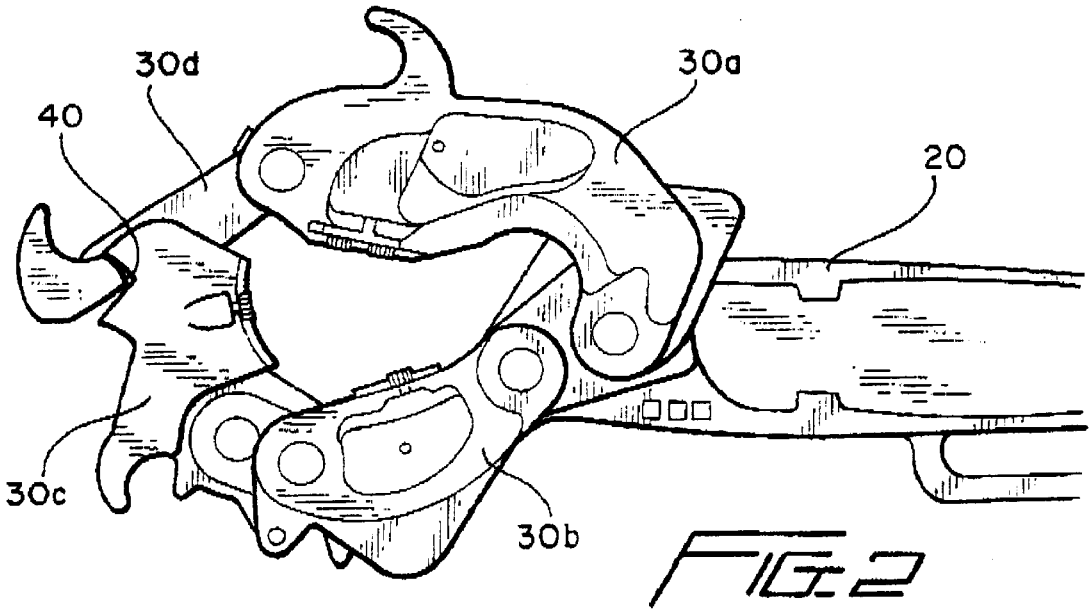
FIG. 2 (PRIOR ART)
FIG. 2 is a top view of a prior art manual pipe tong.

FIG. 2 is a top view of the prior art manual pipe tong, tubular 50 omitted for clarity. Like elements have like reference numbers.

Figure 4A:
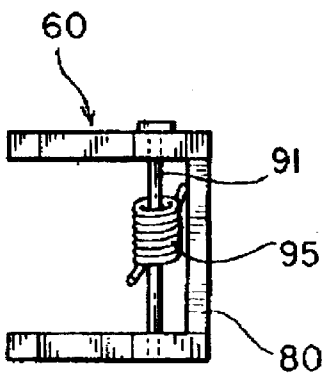
FIG. 4*a* is a side view of the hooking member of the secondary latch, more clearly showing the spring.
Figure 3:
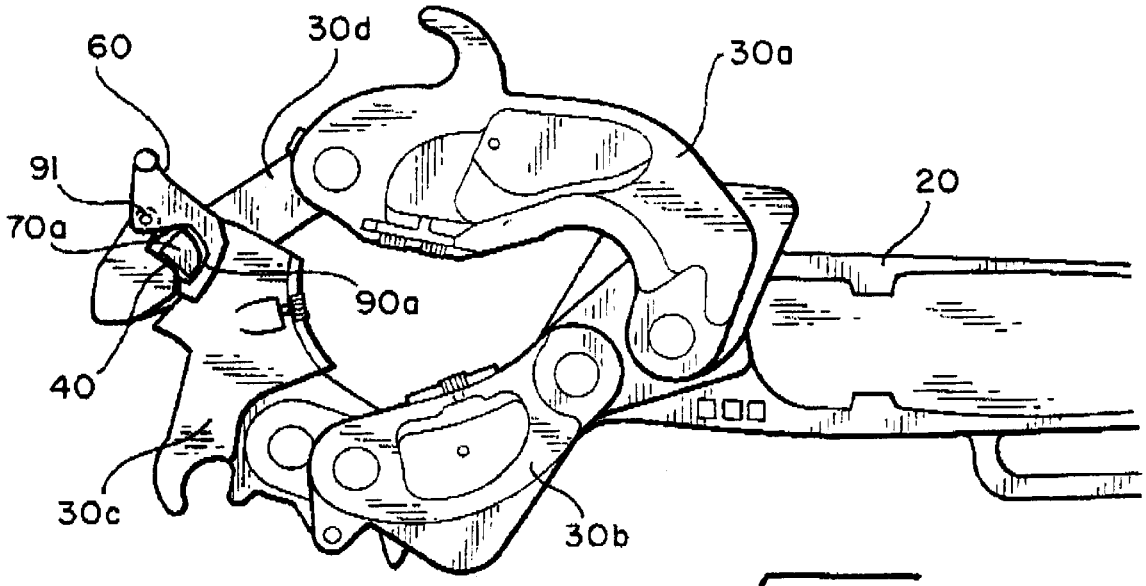
FIG. 3 is a top view of the improved manual pipe tong of the present invention.

FIG. 3 shows a top view of the presently preferred embodiment of the improved manual pipe tong of the present invention, showing secondary safety latch comprising a hooking member 60 having hooks 90*a* and 90*b* (90*b* not shown) pivotally attached to second latch segment 30*d*, and a plurality of hook engaging surfaces, which in the preferred embodiment comprise projections 70*a* and 70*b* (70*b* not shown) on first latch segment 30*c*, hereafter discussed in detail. In FIG. 3, both primary latch 40 (formed by engagement of first and second latch segments 30*c* and 30*d*) and secondary latch (formed by engagement of hooks 90*a* and 90*b* with projections 70*a* and 70*b*) are engaged. In FIG. 3, hooking member 60 is in a first position. In the preferred embodiment, a spring 95 (shown in more detail in FIG. 4*a*) is disposed between hooking member 60 and second latch segment 30*d*, spring 95 biasing hooking member 60 toward the first position. Although a coil spring is shown in FIG. 4*a*, which encircles pin 91 and bears against hooking member 60 and second latch segment 30*d*, it is understood that other configurations of springs could be used, such as a compression spring.

Handle 20 and jaws 30 of the present invention are typically made of a forged or cast metal, such as cast steel. However, other materials may be used, such as other metals or metal alloys, or other materials providing the required strength.

Figure 4:
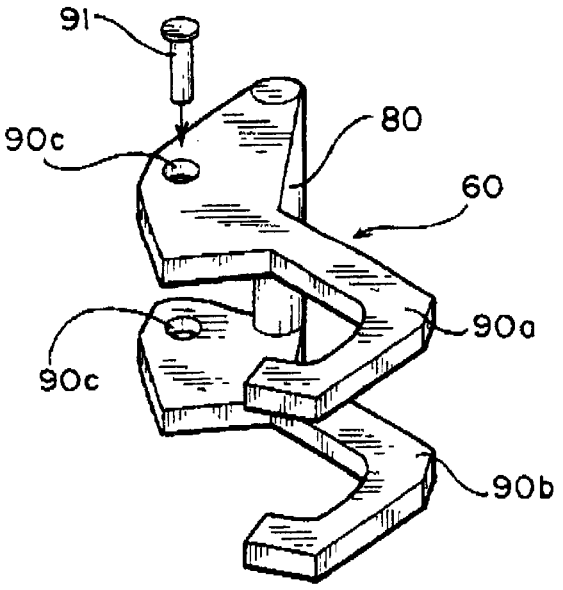
FIG. 4 is a perspective view of the hooking member of the secondary latch.

Referring to FIG. 4, the presently preferred embodiment of hooking member 60 is shown in perspective. Hooking member 60 comprises a handle 80 joining a pair of spaced-apart, opposed hooks 90*a* and 90*b*. Hooking member 60 is rotatably attached to second latch segment 30*d* by pin 91, or other like means inserted through holes 90*c*, thereby forming a pivot point about which hooking member 60 may rotate. Hooking member 60 may be made of various suitable materials well known in the art, including metal alloys and the like. Hooking member 60 is dimensioned so as to adapt to installation on second latch segment 30*d*, with hook 90*a* adjacent an upper surface of second latch segment 30*d* and hook 90*b* adjacent a lower surface of second latch segment 30*d*. The size, shape and configuration of hooks 90*a* and 90*b* may be adapted for advantageous engagement of projections 70*a* and 70*b*. FIG. 4*a* is another view of hooking member 60, showing pin 91 engaged therethrough, and spring 95 encircling pin 91, so that spring 91 can bear against hooking member 60 and second latch segment 30*d*. Hooking member 60 may be formed from metal, metal alloy, or other suitable materials well known in the art, with the different parts joined by welding, or by casting or forging hooking member in one piece.

Figure 5:
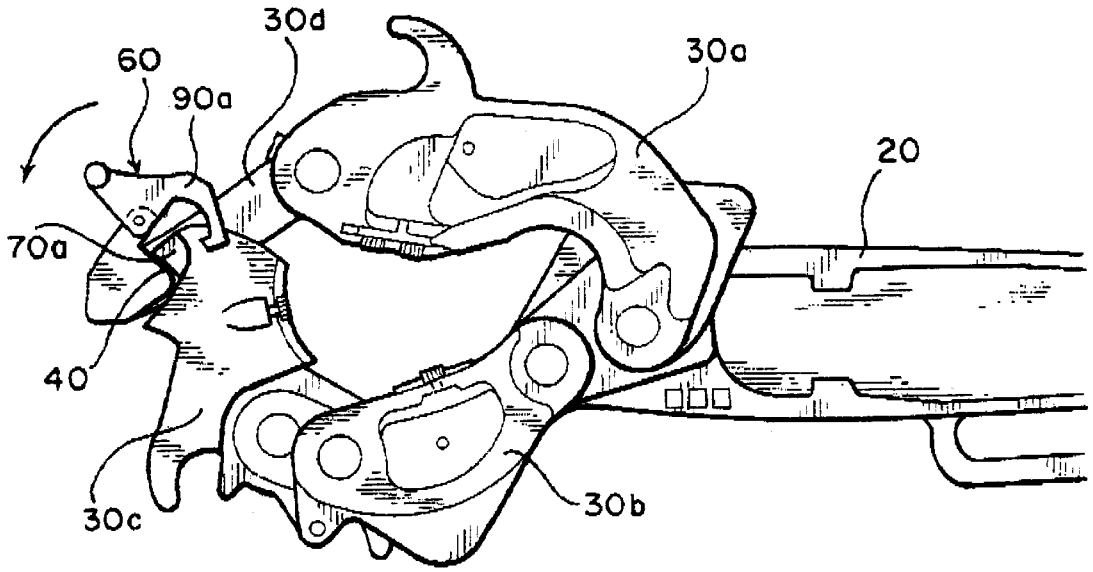
FIG. 5 is a top view of the present invention, showing the primary latch engaged, with the secondary latch unengaged.
Figure 6:
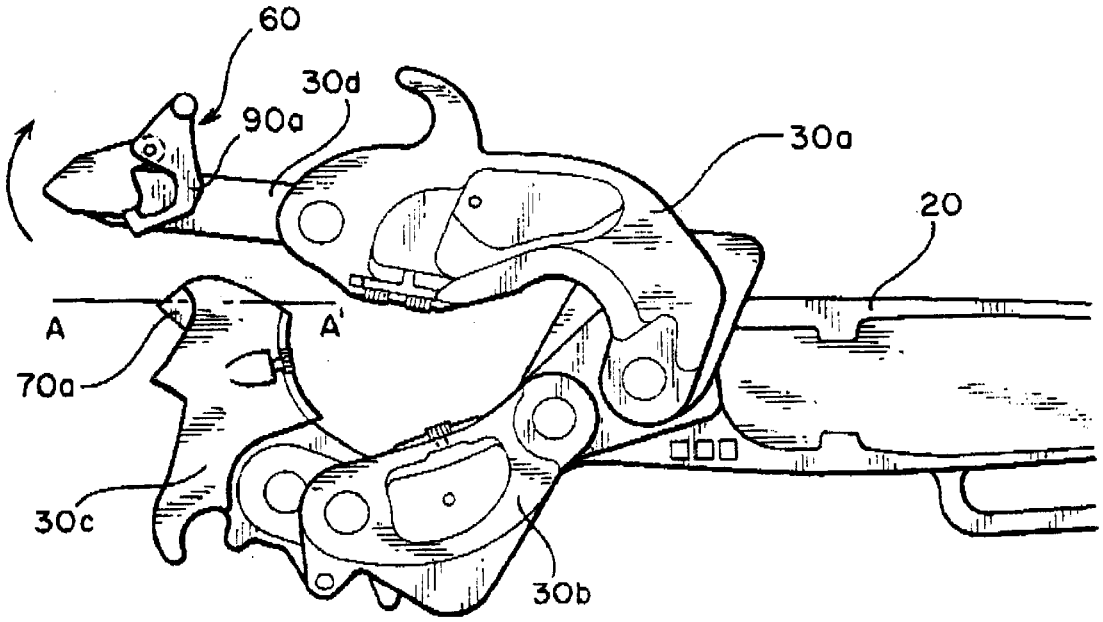
FIG. 6 is a top view of the present invention, showing both the primary and secondary latches disengaged and the latch segments rotated apart.

FIGS. 3, 5 and 6 show the pipe tong of the present invention in different stages of latching. In FIG. 3, as described above, primary latch 40 is engaged, and hooks 90*a* and 90*b* and hooking member 60 are in a first position, engaging projections 70*a* and 70*b* and forming the secondary latch of the present invention. In FIG. 5, hooking member 60 is rotated to a second position, disengaging hooks 90*a* and 90*b* (90*b* not shown) from projections 70*a* and 70*b* (70*b* not shown). Primary latch 40 is still engaged.

In FIG. 6, second latch segment 30*d* is rotated out of engagement with first latch segment 30*c*, and hooking member 60 is rotated back to its first position. In the position shown in FIG. 6, both the primary latch 40 and secondary latch are disengaged, and jaws 30 may then be placed in position to receive a tubular.

In the preferred embodiment, the size, configuration and shape of first and second latch segments 30*c* and 30*d*, hooks 90*a* and 90*b*, and the placement of pivotal mounting point of hooking member 60 may permit the secondary safety latch of the present invention, formed by engagement of hooks 90*a* and 90*b* with projections 70*a* and 70*b*, to latch by rotation of second latch segment 30*d* into its final latched position. That is to say, in that embodiment, hooking member 60 need not be manually rotated to its second position, but rather hooking member 60 (under the bias of spring 95) is pushed out of its first position by contact with projections 70*a* and 70*b*; into its second position by continued rotation of second latch segment 30*d* into the primary latch position; then once second latch segment 30*d* is fully rotated into position against first latch segment 30*c* and primary latch 40 is formed, hooking member is biased by spring 95 and "snaps into" its first position, as shown in FIG. 3, forming the secondary latch.

Figure 7:
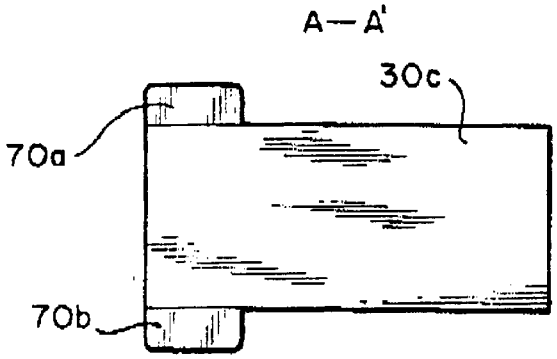
FIGS. 7 and 7*a* are cross sections along section A–A'.
Figure 7A:
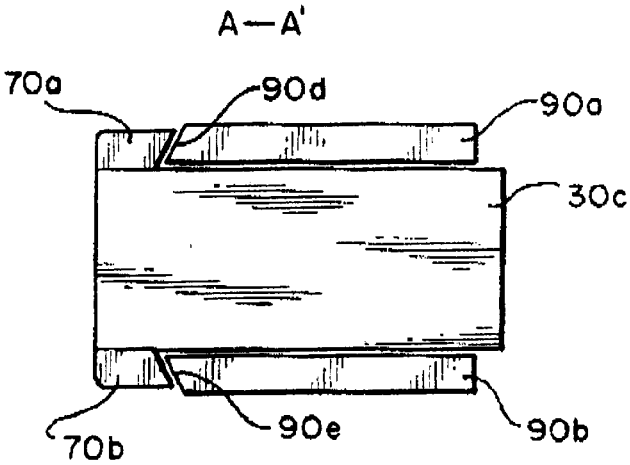

FIGS. 7 and 7*a* show two different embodiments of first latch segment 30*c*, along cross section A–A' from FIG. 6. Referring to FIG. 7, first latch segment 30*c* comprises upper and lower surfaces and comprising an upper projection 70*a* and a like, opposing lower projection 70*b*, for engagement with hooks 90*a* and 90*b* of hooking member 60. Upper and lower projections 70*a* and 70*b* may be formed in various ways: by casting into first latch segment 30*c* when first latch segment 30*c* is formed; by milling, machining or otherwise removing material from the upper and lower surfaces of first latch segment 30*c* to leave upper and lower projections 70*a* and 70*b*; or by adding projections by welding, bolting, or other like means well known in the art. The shapes of upper and lower projections 70*a* and 70*b* are configured so as to cooperatively engage hooks 90*a* and 90*b* of hooking member 60 and form a secure connection point. FIG. 7*a* shows an alternative embodiment of projections 70*a* and 70*b*, and hooks 90*a* and 90*b*. In that embodiment, upper and lower projections 70*a* and 70*b* have an undercut profile, wherein a width of the projections increases in a direction away from the body of first latch segment 30*c*. Hooks 90*a* and 90*b* of hooking member 60, also shown in cross section in FIG. 7*a*, have angled surfaces 90*d* and 90*e*, respectively, configured to engage mating undercut profiles of upper and lower projections 70*a* and 70*b*, thereby tending to force hooks 90*a* and 90*b* into tighter engagement with upper and lower projections 70*a* and 70*b* when force is applied.

To use the apparatus of the present invention, starting from the position shown in FIG. 6, jaws 30 are opened sufficiently to accept a tubular 50. First and second latch segments 30*c* and 30*d* are swung together to form primary latch 40, as shown in FIG. 5. Hooking member 60 is first pushed out of its first position to its second position, then under the bias of spring 95 pushed into its first position and the tong fully latched about tubular 50, as shown in FIG. 3 (tubular 50 omitted for clarity). To disengage tong 10, the foregoing procedure is reversed. In the position shown in FIG. 3, with both the primary latch and secondary safety latch engaged, first and second latch segments 30*c* and 30*d* are prevented from disengagement, and should a jaw segment fail the secondary safety latch formed by hooks 90*a* and 90*b* of hooking member 60 and projections 70*a* and 70*b* maintains the fragments in linked together relationship with the remaining jaw segments, and ultimately with the tong handle.

Figure 8:
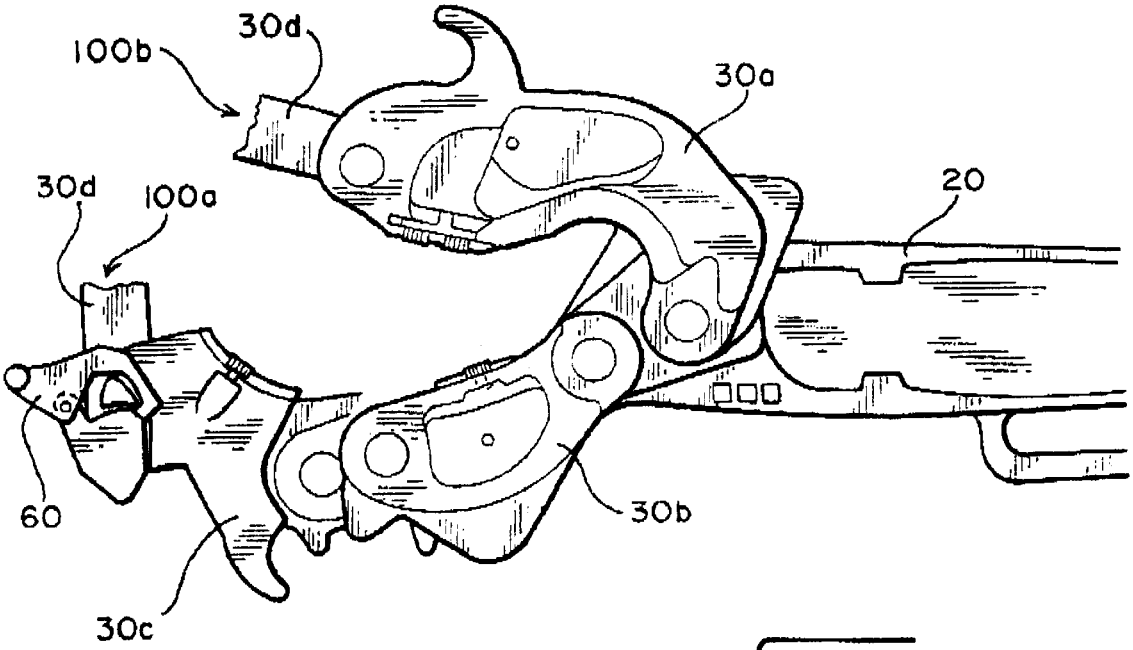
FIG. 8 is a view of the apparatus showing tong jaw fragments retained by the secondary latch of the present invention.

FIG. 8 illustrates the function of the secondary safety latch of the present invention during a failure of a jaw segment. By way of illustration, second latch segment 30*d* is shown as fractured, creating fragments 100*a* and 100*b*. Although jaws 30 disengage from tubular 50 (not shown herein for clarity), it can be seen that the secondary safety latch keeps fragment 100*b* linked to the other jaw segments, preventing fragment 100*b* from becoming a projectile and flying outwardly so as to hurt a nearby worker. Although second latch segment 30*d* is shown as the fractured segment, it is understood that the secondary safety latch effectively links together all jaw segments so that regardless of which segment fractures, no fragments may fly away from the tong.

It can be seen from the description and figures that secondary safety latch comprising hooking member 60 and projections 70*a* and 70*b* also prevents unintentional and unwanted unlatching of first and second latch segments 30*c* and 30*d*, as previously described.

Figure 9:
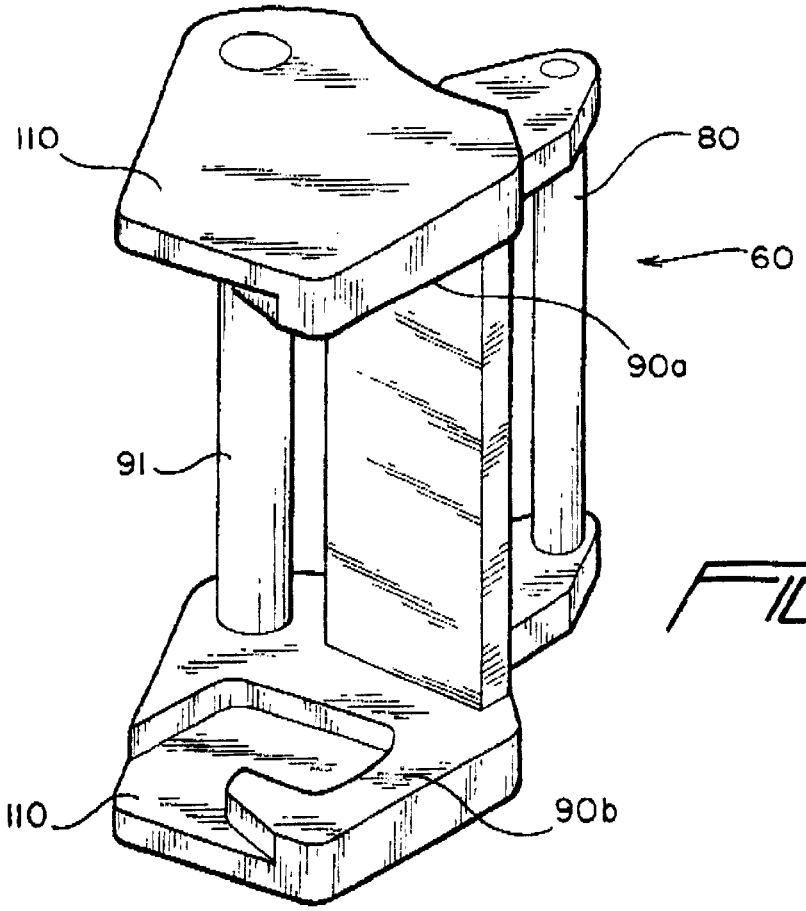
FIG. 9 is a view of another embodiment of the hooking member.

Yet another embodiment of hooking member 60 is shown in FIG. 9. That embodiment comprises end coverings 110 over hooks 90*a* and 90*b*, as shown. End coverings 110 may be formed of separate sheet material (such as sheet steel or the like) attached to hooks 90*a* and 90*b* by welding or other like means. Alternatively, hooks 90 may be integrally formed by machining appropriate profiles into sheet iron, leaving stock in place to form end coverings 110.

Although the description herein contains various particularities and specificities, these are intended to illustrate some of the presently preferred embodiments and not limit the scope of the invention. Various alternative embodiments are possible. For example, different materials may be used for hooking member 60 and projections 70*a* and 70*b*; the shapes of hooking member 60 and projections 70*a* and 70*b*, including the engaging surfaces, may be altered; and the secondary latch may comprise only a single hook (for example, hook 90*a* only) and single mating projection (for example, projection 70*a* only). In other embodiments, a linear movement of the hooking member, rather than a rotational movement, may be used. In such an embodiment, hooking member 60 would move linearly, engaging and disengaging from the hook engaging surfaces in a linear fashion.

Therefore, the scope of the invention should be governed not by the description herein, but by the appended claims and their legal equivalents.

I claim:

1. A manual pipe tong, comprising:

a) a handle;

b) a plurality of linked jaw segments pivotally connected to said handle, two of said jaw segments comprising first and second latch segments, said first and second latch segments releasably engageable with one another to form a primary latch, permitting said jaw segments to be opened to engage a tubular within said jaw segments and said first and second latch segments thereafter engaged so that said jaw segments encircle said tubular; and c) a secondary latch, comprising:

i) at least one hook engaging surface on said first latch segment, and ii) a hooking member rotatably disposed on said second latch segment, said hooking member rotatable between first and second positions, whereby when said first and second latch segments are engaged to form said primary latch, said hooking member in said first position does not engage said at least one hook engaging surface, and said hooking member in said second position engages said at least one hook engaging surface so as to at least partially encircle said at least one hook engaging surface and thereby link together said first and second latch segments independent of said primary latch.

2. An improved manual pipe tong having both primary and secondary latches, comprising:

a) a handle and a plurality of linked jaw segments pivotally connected to said handle, two of said jaw segments comprising first and second latch segments, said first and second latch segments configured to releasably engage one another to form a primary latch, said first latch segment further comprising a hook engaging surface, said jaw segments when latched adapted to engage a tubular member to permit applying torque to a threaded connection; and b) a hooking member rotatably disposed on said second latch segment and comprising at least one hook and a handle, said hooking member rotatable between a first position wherein said at least one hook does not engage said hook engaging surface of said first latch segment and a second position wherein said at least one hook engages and at least partially encircles said hook engaging surface of said first latch segment and forms a secondary latch, said secondary latch adapted to link together said first and second latch segments independent of said primary latch and to prevent disengagement of said primary latch should a tong jaw segment fail.

3. The tong of claim 2, wherein said at least one hook further comprises an end cap covering said at least one hook.

4. A manual pipe tong, comprising:

a) a handle;

b) a plurality of linked jaw segments pivotally connected to said handle, two of said jaw segments comprising first and second latch segments, said first latch segment comprising upper and lower surfaces, said first and second latch segments releasably engageable with one another to form a primary latch, permitting said jaw segments to be opened to engage a tubular within said jaw segments and said first and second latch segments thereafter engaged so that said jaw segments encircle said tubular; and c) a secondary latch, comprising:

i) a hook engaging surface comprising a projection extending outwardly from each of said upper and lower surfaces of said first latch segment ii) a hooking member rotatably disposed on said second latch segment, said hooking member comprising a pair of opposed, spaced apart hooks sandwiching said second latch segment and joined by a handle, said hooks adapted to releasably engage said projections, said hooking member rotatable between first and second positions, whereby when said first and second latch segments are engaged to form said primary latch, said hooking member in said first position does not engage said hook engaging surface, and said hooking member in said second position engages said hook engaging surface so as to at least partially encircle said hook engaging surface.

5. The tong of claim 4, further comprising a spring disposed between said hooking member and said second latch segment, said hooking member biased toward said second position by said spring.

6. The tong of claim 5, wherein said projections have an undercut cross section, and said hooks have a bevel adapted to matingly engage said undercut cross section.

* * * * *